US006062994A

United States Patent [19]

Grimes et al.

[11] Patent Number: 6,062,994

[45] Date of Patent: May 16, 2000

[54] REINFORCED RACQUET WITH FLAT STRING BED

[75] Inventors: Ronald Alan Grimes, Encinitas; Raymond Lee Mortvedt, Santee; Rafael Filippini, Chula Vista, all of Calif.

[73] Assignee: EF Composite Technologies, L.P., San Diego, Calif.

[21] Appl. No.: 09/058,716

[22] Filed: Apr. 10, 1998

[51] Int. Cl.[7] ..... A63B 49/02

[52] U.S. Cl. ..... 473/540; 473/539; 473/542

[58] Field of Search ..... 473/524, 533, 473/537, 539, 540, 542

[56] References Cited

U.S. PATENT DOCUMENTS

| | | | |
|---|---|---|---|
| 1,539,019 | 5/1925 | Nikonow . | |
| 3,547,440 | 12/1970 | Deer | 473/537 |
| 3,605,252 | 9/1971 | Landsman et al. | 473/542 X |
| 3,647,211 | 3/1972 | Doessel et al. . | |
| 3,702,701 | 11/1972 | Vaughn et al. . | |
| 3,810,620 | 5/1974 | Decker, III et al. . | |
| 3,904,202 | 9/1975 | DeLorean . | |
| 3,912,268 | 10/1975 | Robinson . | |
| 3,947,029 | 3/1976 | Gallagher . | |
| 3,968,966 | 7/1976 | D'Aquanni | 473/533 |
| 3,986,716 | 10/1976 | Taussig et al. . | |
| 4,005,862 | 2/1977 | Portz et al. . | |
| 4,145,047 | 3/1979 | Nagamoto et al. . | |
| 4,185,822 | 1/1980 | Li . | |
| 4,192,505 | 3/1980 | Tabickman et al. . | |
| 4,291,574 | 9/1981 | Frolow . | |
| 4,365,806 | 12/1982 | Reid et al. . | |
| 4,664,380 | 5/1987 | Kuebler . | |
| 4,747,598 | 5/1988 | Curtis . | |
| 4,768,786 | 9/1988 | Kuebler . | |
| 4,772,021 | 9/1988 | Maynard . | |
| 4,793,958 | 12/1988 | Mott . | |
| 4,889,337 | 12/1989 | Todd . | |
| 4,911,444 | 3/1990 | Yoneyama . | |
| 4,919,438 | 4/1990 | Yoneeyama . | |
| 4,935,185 | 6/1990 | Mott . | |
| 5,005,834 | 4/1991 | Ferrari et al. . | |
| 5,009,422 | 4/1991 | Soong . | |
| 5,048,830 | 9/1991 | Lo . | |
| 5,060,944 | 10/1991 | Janes . | |
| 5,062,634 | 11/1991 | Strauch et al. . | |
| 5,076,583 | 12/1991 | Hsu . | |
| 5,158,288 | 10/1992 | Chen et al. . | |
| 5,163,679 | 11/1992 | Lo . | |
| 5,165,687 | 11/1992 | Soong . | |
| 5,183,265 | 2/1993 | Umlauft et al. . | |
| 5,192,072 | 3/1993 | Hong . | |
| 5,197,731 | 3/1993 | Svoma et al. . | |
| 5,209,472 | 5/1993 | Tseng . | |
| 5,211,691 | 5/1993 | Sol . | |
| 5,234,657 | 8/1993 | Hong . | |
| 5,236,197 | 8/1993 | Chen . | |
| 5,277,422 | 1/1994 | Coe . | |
| 5,306,004 | 4/1994 | Soong . | |

(List continued on next page.)

OTHER PUBLICATIONS

CONVEX Comp badminton racquet by Fortune Sports Co. Ltd.; believed to be manufactured in accordance with the enclosed patent application entitled "Improved Racket"; it is our understanding that the first page, which is in Chinese, is a letter from a Taiwanese patent agency, transmitted Jul. 21, 1994, enclosing an application for filing in the United States. No translation of this reference is available.

*Primary Examiner*—Raleigh W. Chiu

*Attorney, Agent, or Firm*—Jefferson Perkins; Foley & Lardner

[57] ABSTRACT

A sports racquet has a head frame that includes a support member and an inwardly directed alignment member or fin. String segments are strung from a central strung area through respective holes in the fin, around the support member and back through further holes in the fin. The present invention provides a strong anchor for the strings which can withstand the static load thereof as well as dynamic loading placed on it by striking gamepieces as well as striking other objects. In a preferred embodiment, the fin returns the string segments to a strung area that is substantially planar up to the inner periphery of the fin.

28 Claims, 8 Drawing Sheets

U.S. PATENT DOCUMENTS 5,310,180 5/1994 Wu .
5,312,115 5/1994 Wu .
5,368,295 11/1994 Severa et al. .
5,368,296 11/1994 Liu .
5,423,532 6/1995 Huang ..... 473/533
5,467,982 11/1995 Tseng .
5,538,243 7/1996 Yamamoto et al. .
5,540,434 7/1996 Garrett, Jr. et al. .
5,716,296 2/1998 Umlauft .
5,743,822 4/1998 Tarleton ..... 473/533
5,823,899 10/1998 Goodge ..... 473/540

REINFORCED RACQUET WITH FLAT STRING BED

TECHNICAL FIELD OF THE INVENTION

The present invention relates in general to sports racquets, such as racquetball racquets, tennis rackets, squash racquets and badminton racquets, and more particularly to strung racquets having reinforcing elements.

BACKGROUND OF THE INVENTION

Sports racquets, such as tennis rackets and racquetball racquets, have evolved with the objective of improving their strength to weight ratio. Originally made of wood, the frames of sports racquets later were made of aluminum alloy and now are mostly made of composite laminates of fiber and thermosetting organic resin. "Racquet", as used herein, encompasses racquetball racquets, tennis rackets, badminton racquets, squash racquets and any other sports implement that has a head which is strung with string or netting and which is designed to intercept and return a projectile.

In the most conventional sort of strung racquet, the striking area is defined by a head frame that is roughly oval in shape. Holes are made through the frame, typically in the plane of the strung area, for the passage of string therethrough. While this construction yields a desirably flat strung area without significant departures therefrom of the individual string segments, each string hole weakens the frame. It has been discovered that the most common impact failure mode of such racquets is a break in the frame at such a hole. Racquetball racquets, in particular, must exhibit considerable impact resistance because of their frequent contact, both inadvertent and intentional, of the walls and floor of the regulation racquetball court and other racquets.

Advances have also been made to improve the stiffness of the racquetball frame. One advance, used in a known badminton racquet, is to incorporate a structural fin which projects inwardly from the main frame member, itself usually formed as a tube having varying shapes or otherwise strengthened cross section. The fin in this badminton racquet is disposed inwardly around the entire circumference of the head frame and is used as an anchor for the string segments. In this embodiment, holes are made in the fin rather than in the tube. While this improves the strength of the tube, it is believed that if this design were used for racquetball or other racquet sports in which an elevated amount of equipment abuse occurs, other failure modes would arise: those of separation of the fin along its join with the head frame and the tearing out of the strings through the fins. To prevent this failure mode the fin would have to be increased in size and weight, with negative effects on playability.

Another conventional way to avoid frame-weakening holes is to wrap the string around the head using channels in the frame bumper for the purpose. This has the undesirable effects of introducing strings from the frame sides into the string bed at various angles to the general plane of the strung area and reducing the size of the flat portion of the strung bed. When a projectile such as a racquetball hits such a string in the vicinity of the frame, the projectile will be returned in an unanticipated direction, degrading playability. A need therefore persists in the sports racquet industry for racquets with improved strength to weight ratios and substantially flat strung areas.

SUMMARY OF THE INVENTION

According to one aspect of the invention, a sports racquet has a handle and a frame operatively connected to the handle that includes an elongated support member. The support member defines a strung area across which a plurality of string segments are strung. The strung area exists within a strung area plane. The support member acts as the main anchor for the string segments, which are held in tension between opposed sides of the support member, or between a top of the support member and one or more anchor points disposed in or near the racquet handle.

The frame further includes one or more strung area plane alignment members, preferably but not necessarily formed as a single, elongate fin that is integrally formed with the support member and which projects inwardly so as to be generally coplanar with the strung area plane. The alignment member acts to redirect string segments strung from the support member into the general plane of the strung area. In this way, the strength of the entire cross-section of the support member can be employed while at the same time the planarity of the string bed right up to the interior physical limit of the frame can be maintained. This enhances ball control, racquet playability and product durability.

According to another aspect of the invention, the strung area plane alignment member has formed therein a plurality of holes through which the string segments are routed and redirected. The string segment is passed around the support member to take advantage of its full tension-resisting strength, and then threaded through a respective hole in the strung area plane alignment member. After passing through the hole, the string segment enters the string bed so as to be substantially planar therewith. Because the entire cross section of the relatively robust support member is used to resist forces put on the frame by the string segments, little force is placed on the alignment member and therefore this can be of fairly limited cross section and extent, with no special reinforcement being needed.

According to yet another aspect of the invention, a bead is formed on the alignment member to have a thickness which is greater than the general thickness of the alignment member and to be disposed inwardly of the string holes. Preferably, this bead extends both upwardly and downwardly from the alignment member such that strings disposed on either side of the alignment member will contact the alignment member in only two places: the bead and the string hole. In this way, contact of the string segment with the alignment member proper is avoided, reducing friction and enhancing the response of the string segment when returning a projectile.

Many variations of the invention are possible. The fin could be disposed in a plane other than the plane of the strung area, such as orthogonal to the strung area plane; there can even be intentional variance of the angular disposition of the fin along its length. Instead of one, single, elongated fin, one could provide a plurality of fins or lugs, each of which could receive and redirect one or a small number of string segments; these multiple small fins could be aligned with the strung area plane or disposed elsewhere.

Embodied as a unitary elongate fin, the alignment member could extend completely around the periphery of the strung area or only around a portion of the periphery of the strung area. As a string segment plane alignment member, the fin can be integrally formed with the support member; made separately and later joined to the support member, as by means of an inward-facing channel in the support member; joined to the support member by means such as an intervening elastomeric member; or disposed at a floating position spaced interiorly of the support member, and held in place only by the string segments redirected thereby.

More than one elongate fin can be provided, and the holes in the fin member may be other than at right angles to the plane of the strung area.

The preferred embodiment serves the double objective of eliminating most or all of the string holes in the support member, while redirecting the string segments to the general plane of the strung area, such that a large majority of the strung area is coplanar, even up to its physical margin. The present invention permits improved support member strength and in-plane stiffness and stability. Alternatively, the present invention can permit, by design trade off, a reduced cross-section of the head frame and therefore a reduced weight with the same stiffness and stability characteristics. Further, the strength or stiffness at any particular locality along the head frame can be controlled by local variation of the fin, such as by choosing by the number and spacing of individual lug elements or varying the disposition or angle of them with respect to the strung area plan.

BRIEF DESCRIPTION OF THE DRAWINGS

Further aspects and advantages of the invention can be discerned from the following detailed description in which like characters identify like parts and in which.

DETAILED DESCRIPTION OF ILLUSTRATED EMBODIMENT

Figure 1:
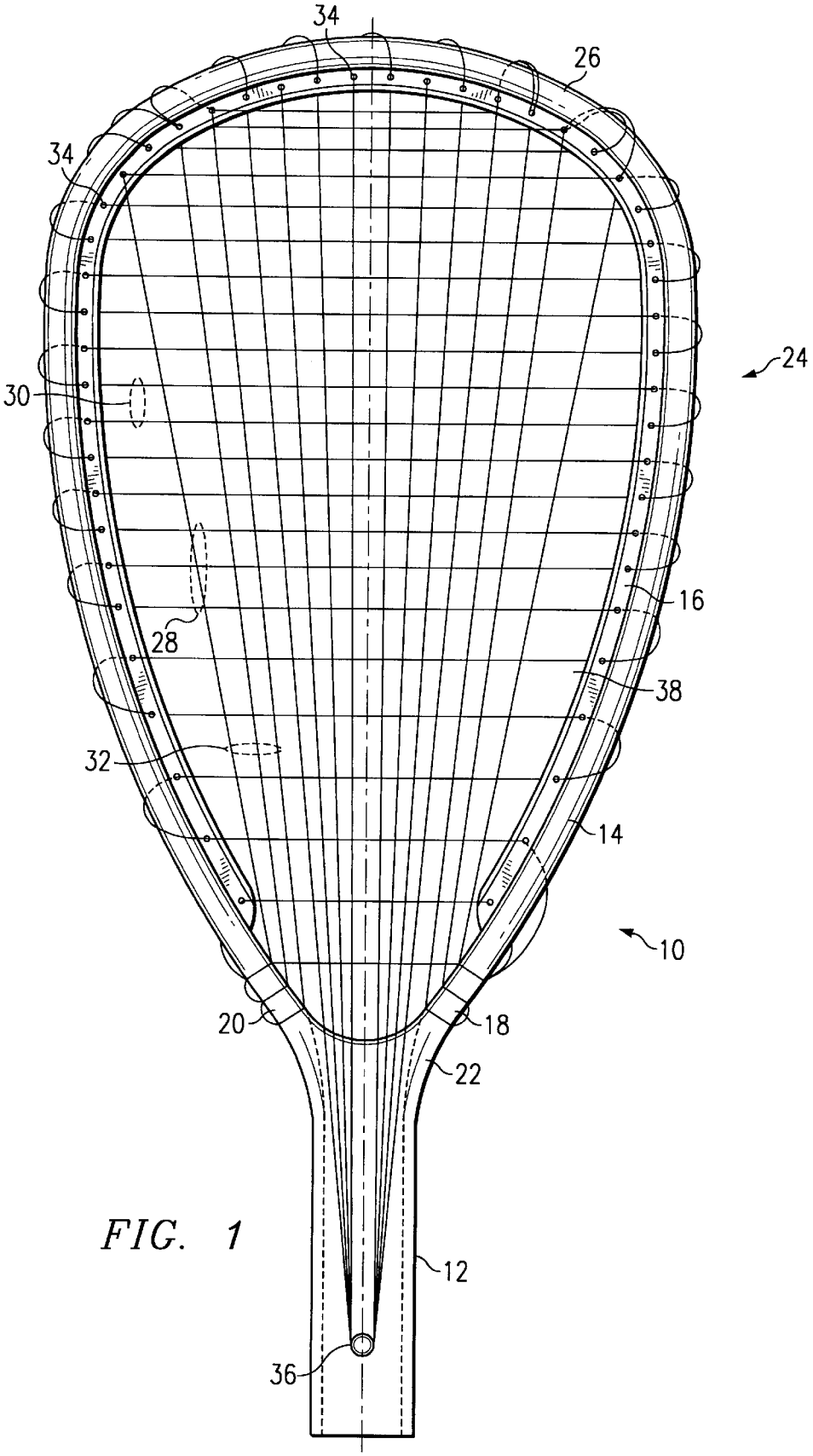
FIG. 1 is a part-plan, part-sectional view of a racquetball racquet employing the invention.

A preferred embodiment of the invention is shown at 10 in FIG. 1. The illustrated racquet 10 is a racquetball racquet. The invention could easily be employed with other types of strung sports racquets, such as those used for tennis, badminton or squash. FIG. 1 is schematic in that it shows only the basic framework and the racquet's stringing; for purposes of clarity, the components which make up the external handle grip and cap, and the conforming piece which is added later as a head bumper (see FIG. 17), have been omitted.

The racquet 10 has three basic structural components: a handle 12 which in the illustrated embodiment is formed as a hollow tube, a string segment support member 14 which defines a strung area and supports the string bed, and a string segment alignment member 16 that preferably is disposed interiorly of the support member 14. The support member 14 forms a continuous arc between its opposed ends 18 and 20, which are joined to (and preferably are made integrally with) the handle 12 through a transition or throat region 22. The support member 14 and the alignment member 16 together form a head frame 24, which has a top 26 in opposition to the handle 12. In shafted racquet embodiments, such as those used in tennis and badminton (see Figure ) a shaft would act as the operative connection between the head frame 24 and the handle 12. The head frame 24 can also be thought of as consisting of opposed sides, between which a string area is defined and each extending from the top 26 to the throat region 22.

The racquet 10 further includes a plurality of string segments 28. The string segments include horizontal string segments 30 and substantially vertical string segments 32. In the illustrated embodiment, the vertical string segments 32 extend from anchor points or grommets 34 in the alignment member 16 within an arc of the head frame 24 that extends on either side of the top 26. The other ends of most of the vertical string segments 32 terminate in a single post 36 which is disposed to span the interior sidewalls of the hollow handle 12. The string segments 30 and 32 can be individual string segments, but they can be segments of longer strings. It is preferred that they be a portion of a single long string which is strung throughout a strung area 38. According to one important aspect of the invention, the strings 32 and the strings 30 occupy substantially a single plane. The invention permits the plane of the strung area 38 to extend right up to the margin of the alignment member 16, so that a racquetball which hits anywhere inside the strung area 38 will be returned at a predictable angle.

While the handle 12 and head frame 24 of the present invention can be formed of any of several strong materials, it is preferred that it be made as a composite of graphite and fiberglass fiber material and thermosetting resin. Since the process of molding racquets of composite material is well known in the art, it will not be described in further detail here.

Figure 2:
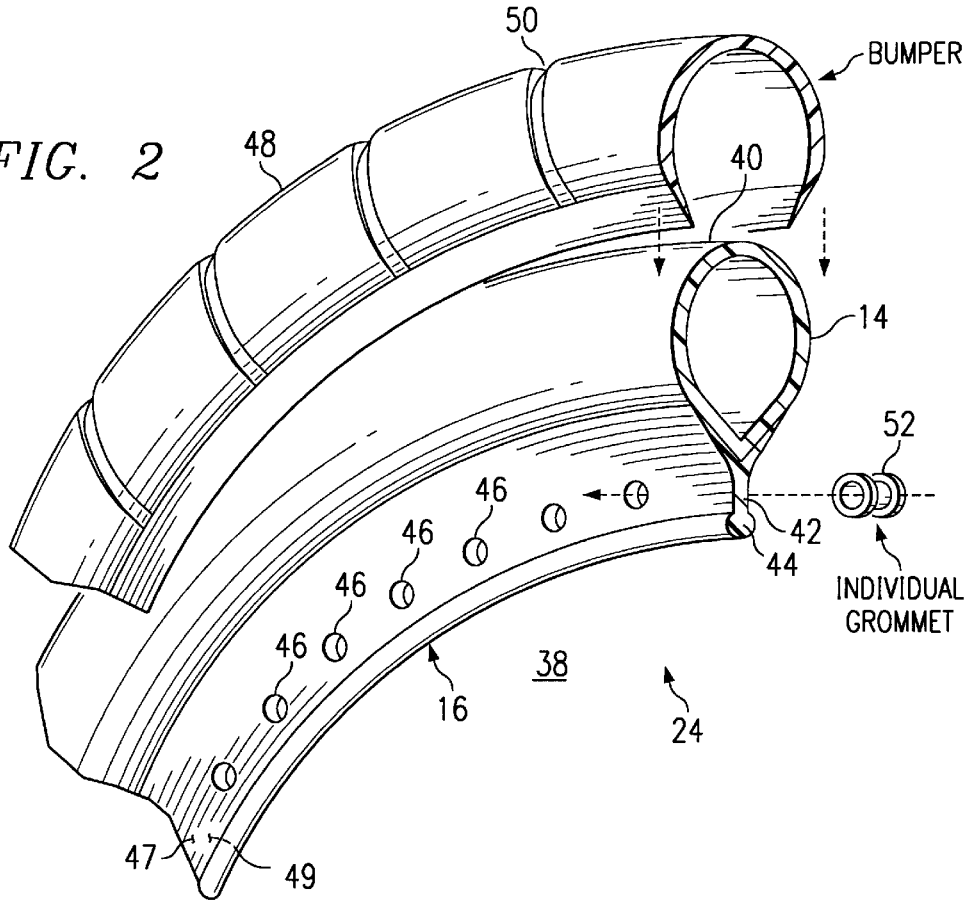
FIG. 2 is an exploded detail view of a head frame according to a preferred embodiment of the invention.

FIG. 2 is an exploded view of a small section of the head frame 24. The head frame 24 comprises a tubular support member 14 whose cross-section is roughly oval in shape. More complicated cross-sectional shapes may be employed instead of the one shown, as needed for strength and/or playability. The support member 14 has a back surface 40 that is disposed on the outside of the head frame in a position remote from the strung area 38, and an inner surface 42 which is disposed to be proximate the strung area 38. It is preferred that the alignment member or fin 16 be integrally formed with the support member 14 out of composite material as above explained. However, separately formed alignment member inserts may be used instead, as will be described later.

Also in a preferred embodiment, the alignment member or fin 16 terminates at its interior edge in a bead 44 that has a thickness larger than that of the fin 16 immediately adjacent to it and which preferably runs the entire length of the alignment member 16. The alignment member or fin 16 has a first surface 47 and a second surface 49 that is opposed to the first surface, the surfaces 47 and 49 being roughly in parallel to each other. The bead 44 acts as an eminence which bulges outwardly (upwardly and downwardly with respect to the plane of the strung area 38) with respect to the surface 47 and also with respect to the surface 49. In other words, preferably the bead 44 is elevated with respect to the generally flat surface 47 as well as the generally flat surface 49 when these surfaces are viewed in profile.

A plurality of string holes 46 are formed in the fin 16 to extend between surfaces 47 and 49. To increase the strength of the support member 14, it is preferred that the string holes 46 not be formed in the support member 14. This permits the frame 24 to be much stronger and to more effectively resist fracture at a string hole, which is by far the most common failure mode of conventionally designed sports racquets. Some holes in the head frame may be permitted, as where the presence of the fin would occlude the stringing of string segments, as occurs in the throat region 22 in FIG. 1. In general, however, the number of holes in the head frame should be minimized, especially near top 26.

Figure 18:
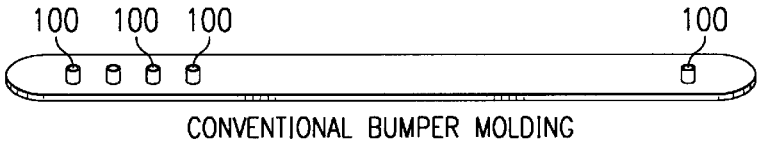
FIG. 18 (PRIOR ART)
FIG. 18 is a conventional bumper molding according to the prior art.

A bumper 48, which for example may be formed of nylon or polycarbonate, is fit onto the back surface 40 of the support member 14 at least through an arc of the frame centered at the top 26 (FIG. 1). The bumper 48 may be bent around the periphery of the head frame 24 from a piece of straight stock (see FIG. 18) or may be custom-molded. Preferably, the bumper 48 is stretched onto the support member 14 so that it is under tension. A polycarbonate bumper 48 would allow the racquet designer to reduce the cross section of the support member 14 along the arc to which the bumper 48 is mounted, as polycarbonate is a structurally strong material. The use of a polycarbonate bumper may therefore be used to reduce the weight of the head frame 24 in the vicinity of the top 26, always an objective to the racquet designer. In any event, the bumper 48 should be formed of a material which is strong, light-weight and abrasion-resistant.

In addition to absorbing shock, the bumper 48 functions to include a plurality of channels 50 for protecting the individual string segments as they are routed around the back surface 40 of the support member 14. Alternatively, the string segments may be routed underneath the bumper 48.

In a preferred embodiment, a grommet 52 is inserted into each string hole 46. The grommet 52 permits the racquet stringing material to more easily slide through the holes 46 and protects the tensioned racquet string segments from being cut or abraded at the holes 46.

Figure 3:
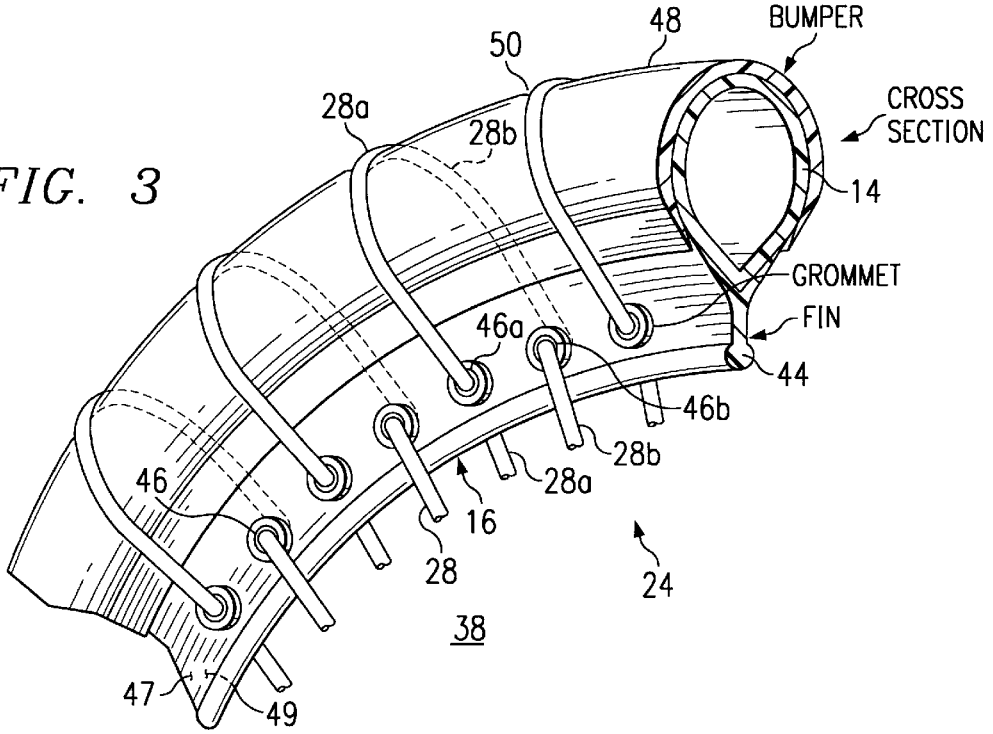
FIG. 3 is a perspective view of the head frame detail shown in FIG. 2, shown assembled and strung with string segments.

FIG. 3 shows the segment of the frame 24 illustrated in FIG. 2, but this time in an assembled condition and strung with a plurality of string segments 28. In FIG. 3, the preferred method of routing the string segments 28 is shown. Taking string segment **28*a* as an example, the string segment is routed from the rear surface 49 to the front surface 47 through grommeted hole 46*a*. The string segment 28*a* then continues outwardly around the sidewall and back surface of the bumper 48, in channel 50, the bumper 48 in turn being which in turn is mounted on the support member 14. The return path of the string, which at this point becomes a string segment 28*b* that is a continuation of string segment 28*a*, is shown in hidden line going around the back of the bumper 48 and the back surface 40 of the head frame 14. The string segment 28*b* is then pulled through a grommeted hole 46*b* in a direction from surface 47 to surface 49, which is opposite to the stringing of the string 28*a* through the grommeted hole 46*a*. As can be seen, the string segments 28*a* and 28*b* depart by a great deal from the plane of the strung area 38 as they proceed around the support member 14, but the fin or alignment member 16 causes the string segments 28 to be realigned with the strung area plane 38. Because the support member 14 has few or no holes drilled in it, it can better withstand the static loads imposed by the tensioned string segments 28**, as well as impact loads imposed by striking a gamepiece or by the racquet striking another object.

As also be seen in FIG. 3, the bead 44 provides a limited contact surface with each of the strings segments 28. Because they are not contracted along an entirety or even most of the surfaces 47 and 49 of the alignment member 16, the string segments 28 will not be as impeded in linear movement as they otherwise would be, and the play will be livelier. By use of the bead 44, the string segments 28 contact the alignment member 16 only at the bead 44 and the string holes 46.

Certain prior art racquets string the string segments 28 to and from the holes 46 without passing the string segments around the support member 14. This prior art stringing method does not take advantage of the superior strength of the support member 14. Using just the fin or alignment member 16 will cause an increased incidence of one or two new failure modes, one in which the fin 16 separates from the support member 14 or one in which the string holes 46 fracture and fail resulting in string pull-out. The present invention obviates these failure modes by putting at least a large portion of the string loading on the support member 14 rather than by making fin 16 heavy and therefore reducing playability characteristics.

Figure 4:
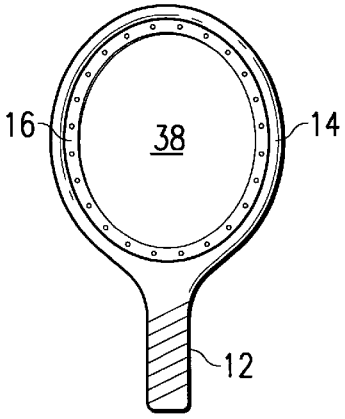
FIG. 4 is a simplified schematic view of an alternative embodiment of the invention, showing a closed annular fin member.

FIG. 4 is a high level schematic illustration of a further embodiment of the invention. In this embodiment, a circumferential support member 14 is provided as before, but this time, instead of the alignment member 16 extending through only a portion of the strung area periphery, the alignment member 16 becomes annular. This construction is particularly useful in those sports racquets that do not have string segments which terminate inside or near the handle 12.

Figure 5:
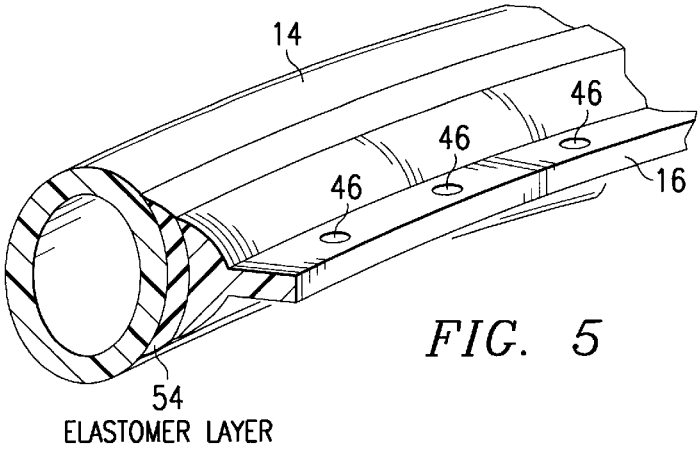
FIG. 5 is a cross-sectional detail of the frame of a further embodiment of the invention, showing the use of an elastomeric layer in between a support member and an alignment member.

FIG. 5 illustrates a further embodiment of the invention, in which the support member 14 and the alignment member 16 are not directly joined together but rather are joined by an interposed layer 54 of elastomeric or other material. The elastomeric member 54 has a dampening effect on the string segments 28 (not shown).

Figure 6:
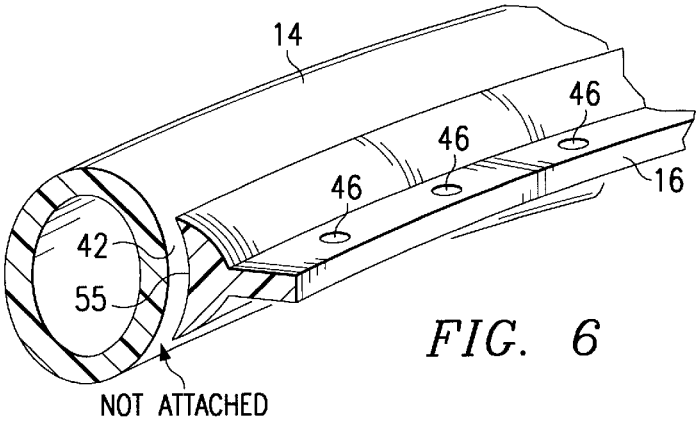
FIG. 6 is a cross-sectional detail similar to that shown in FIG. 5, but showing an embodiment in which the alignment member is spaced interiorly of the support member.

In FIG. 6, a further embodiment of the invention is shown, this time with a simple tubular support member 14 and a free floating alignment member 16. A floating alignment member 16 may be so disposed because its physical position will be constrained by the strings (not shown) passing underneath and over it. It is also possible to have the alignment member 16 abut the interior surface 42 of the support member 14, and to have a concave surface 55 of the alignment member 16 coact with the convex inner surface 42 of the support member 14 such that there will be sliding relative movement of the two surfaces when a gamepiece is struck.

Figure 7:
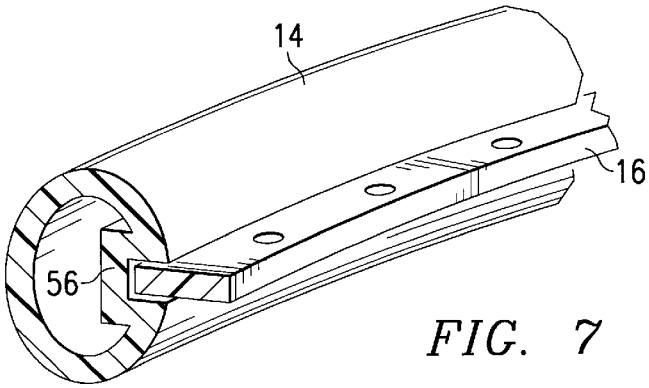
FIG. 7 is a similar view of yet another embodiment, in which the alignment member is placed within a channel formed within the support member.

In FIG. 7 yet a further embodiment of the invention is shown in which a channel 56 is formed into the support member 14 such that the alignment member 16 is fit or bonded to the support member 14 within the channel 56.

In any of the embodiments illustrated herein, the alignment member 16 may be formed of a relatively flexible material instead of a rigid material where an elastic response to impact is desired.

Figure 8:
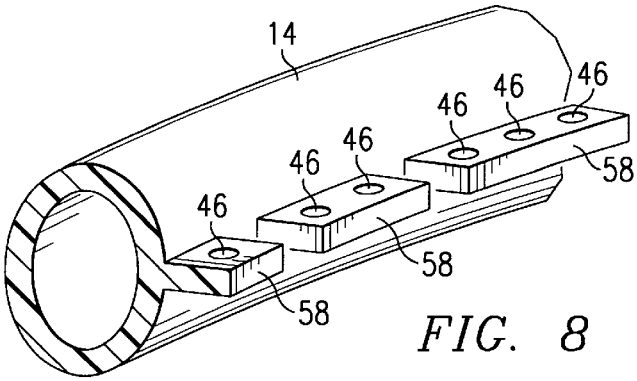
FIG. 8 is a similar cross-sectional detail of a further embodiment of the invention, illustrating the use of a plurality of discrete alignment members in the place of a single elongated alignment member.

In FIG. 8, the single alignment member is replaced with a plurality of fins, lugs or alignment members 58. Each one of the fins or lugs 58 is joined to the support member 14 and each lug 38 may have one, two, three or more string holes 46 formed in them.

Figure 9:
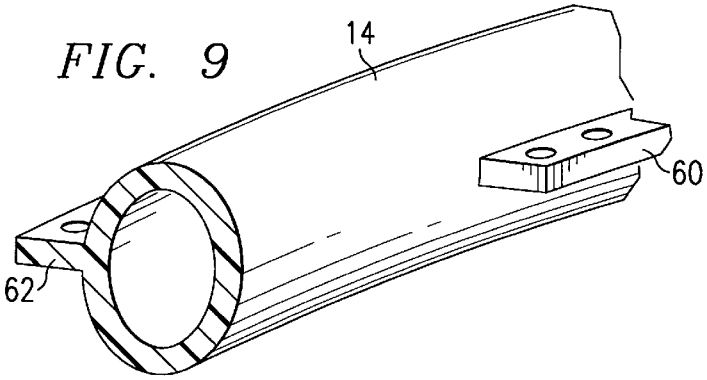
FIG. 9 is a detail showing yet a further embodiment of the invention, showing the disposition of multiple alignment members at various locations on the support member.
Figure 10:
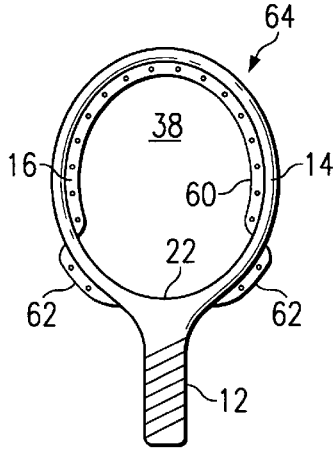
FIG. 10 is a simplified schematic view of a sports racquet employing the embodiment shown in FIG. 9.

In the embodiment shown in FIG. 9, an interiorly directed lug 60 is formed on the support member 14, while an exterior fin or lug 62 is formed to extend outwardly. As shown in FIG. 10, these fins or lugs can be disposed such that most of the periphery of the strung area 38 is surrounded by an arcuate, inwardly projecting fin 60, and such that outward portions 62 are positioned adjacent to the throat 22.

Figure 11:
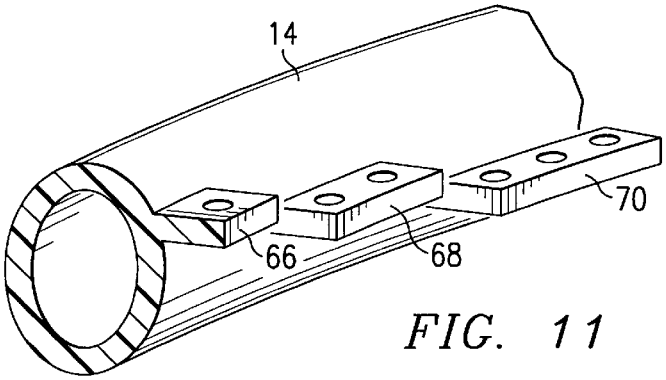
FIG. 11 is a cross-sectional detail of a frame according to a further embodiment of the invention, illustrating the use of several alignment members in multiple staggered parallel planes.
Figure 12:
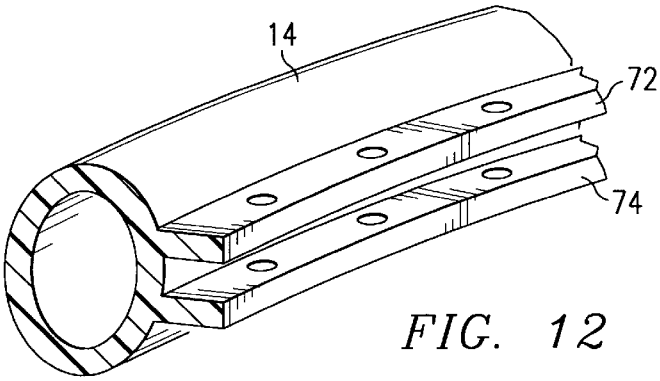
FIG. 12 illustrates yet a further embodiment of the invention, in which two alignment members are joined to a support member and are in parallel to each other.
Figure 13:
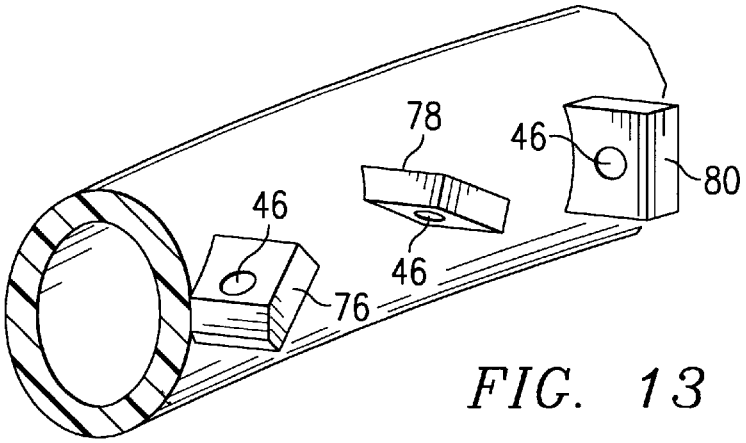
FIG. 13 is a cross-sectional detail of yet a further embodiment of the invention, in which a plurality of alignment members are provided, and in which they are disposed at varying angles to the plane of the strung area.

FIGS. 11–13 show further variations in fin placement. Whereas in FIG. 8 the fins 58 are in a single plane which is in alignment with the plane of the strung area 38, in FIG. 11 fins 66, 68 and 70 are formed together with the support member 14 to be disposed in multiple staggered parallel planes. In FIG. 12, the support member 14 is provided with two inwardly directed fins 72 and 74, one above the strung area plane 38 (FIG. 1) and one below. In FIG. 13, a series of lugs 76, 78 and 80 are positioned so as to be intentionally nonparallel to each other. These lugs will behave differently from each other when subjected to the dynamic loading of a string strung through the respective string holes 46.

Figure 14:
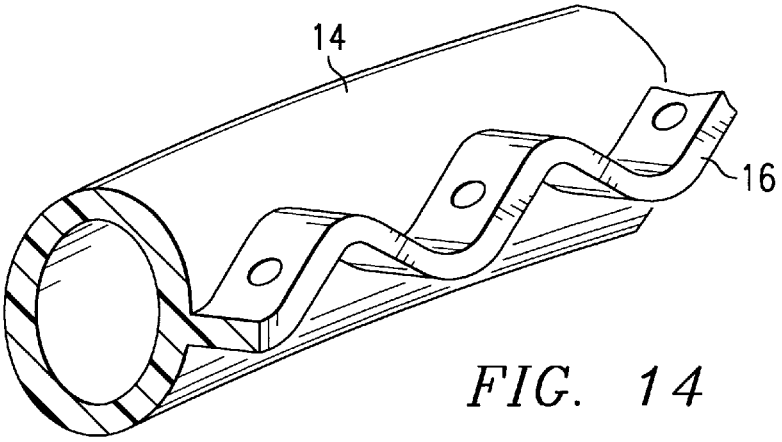
FIG. 14 is a cross-sectional detail of yet a further embodiment of the invention, illustrating a single alignment member that is sinuous or wavy.
Figure 15:
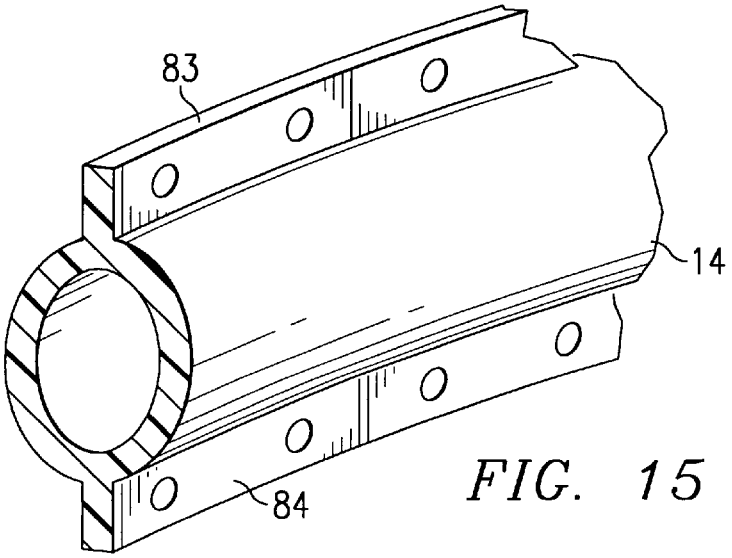
FIG. 15 is a cross-sectional detail of yet a further embodiment of the invention, illustrating the use of fins projecting from the support member in different angular directions.

In FIG. 14, there is seen a wavy, corrugated or serpentine alignment member or fin 16 which is joined to the support member 14 on an interior surface thereof. The alignment member 16 in this condition will have a tendency to deflect less than one which is in complete alignment with the strung area 38 (FIG. 1). In FIG. 15, the support member 14 is provided with opposed fins 83 and 84. Fins 83 and 84 still permit the string segment to wrap around the back side or surface of the support member 14 but position the string segments in a predetermined way with respect to the strung area.

Figure 16A:
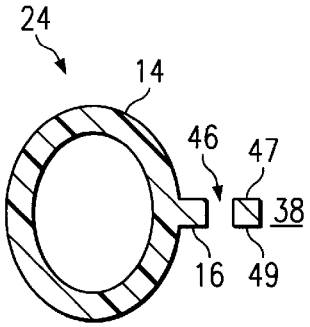
FIGS. 16*a*–16*c* illustrate different embodiments of an alignment member and support member according to the invention, in which there are shown variations in hole alignment.
Figure 16B:
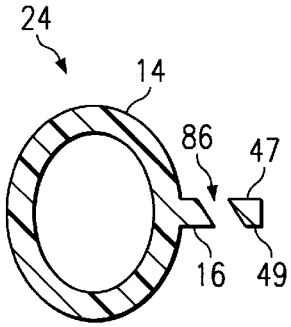
Figure 16C:
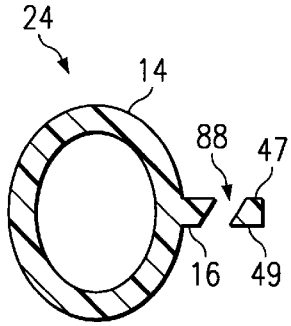

FIGS. 16*a*–16*c* are sectional views taken through the head frame 24 at a location of a string hole. FIG. 16*a* illustrates an embodiment in which the string hole 46 is formed to be perpendicular to the plane of the strung area 38. However, perpendicularity is not absolutely necessary and there are advantages to other positions. In FIG. 16*b*, a string hole 86 is provided which is slanted toward the support member 14 on the upper side 47 of fin 16 and away from the support member 14 and toward the strung area 38 on the lower side 49 of fin 16. FIG. 16*c* illustrates the reverse case, in which a string hole 88 has an opening on lower surface 49 which is closer to the support member 14 and an opening on upper surface 47 that is farther away. The string holes 86 and 88 may be used alternately around the periphery of the head frame 24 to more easily direct string segments to and from the support member 14. The use of alternately angled string holes will cause more of the string tension and the impact loading to be borne by the relatively robust support member 14 and less by the alignment member 16.

Polycarbonate Bumper

The plastic bumper 48, which is normally laced to the bow or top end 26 of racquetball racquets, and commonly seen on tennis and squash racquets as well, is intended to protect the frame 24 and string segments 28 from court abrasion. In conventional designs using frames with string holes, the bumper provides grommets 100 (FIG. 18) that direct and protect strings as they penetrate through string-holes in the frame.

Since 1970, with the introduction of the Head "Master" tennis racquet see, for example in U.S. Pat. No. 3,702,701, nylon bumper/grommet strips, "stitched-on", have been in dominant usage. The exception was the vinyl extrusion bumper used on many aluminum racquetball racquets during the 1970's.

Since approximately 1980, nylon has been used to the virtual exclusion of other materials, due to reasonably good abrasion resistance, toughness, and very string-wear-friendly properties. Nylon (polyamide, generically) monomers used include Nylon 6; Nylon 6,6; Nylon 11; Nylon 12; and ST801.

Impact resistance, especially for indoor court sports, is strongly desired in the racquets to keep them from breaking. Innovations in nylon bumper configuration, and the addition of damping materials beneath them to enhance impact resistance, have proven to be only marginally effective.

General Electric developed a plastic, during the early 1970's, for better impact and abrasion resistance. The generic "polycarbonate" was given the trademark LEXAN®. Current variations on this resin are manufactured by GE, Dow, Mobay, Polymer Resources, and Shuman.

This material was tested as a bumper 48 in the present invention and appears to provide superior impact and abrasion resistance performance. Other materials may also be effective, such as other amorphous polyesters. Generally, any polymer which meets a criterion of greater than 10 ft-lbs./inch of notch according to the ASTM D256A testing standard (Izod impact, ⅛" specimen) can be substituted. The benefits include better abrasion resistance, thus longer lasting string protection; better impact resistance, thus longer racquet service life; behavior as a structural adjunct for impact protection, therefore materials in the racquet structure dedicated to this purpose may be removed, or rededicated to stiffening the bow region 26; and easier racquet installation than is the case with conventional bumpers.

Figure 17:
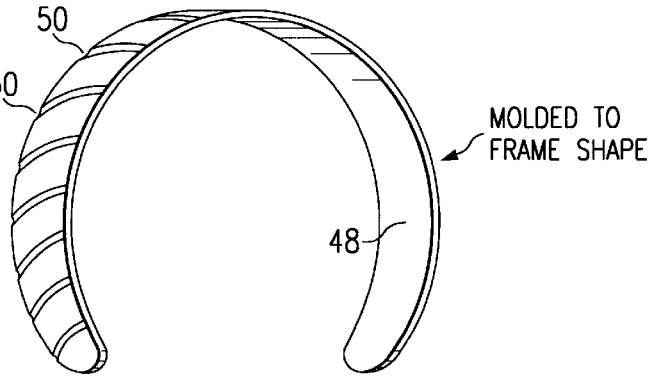
FIG. 17 is a perspective view of a polycarbonate bumper according to one aspect of the invention.

Due to the stiffness of polycarbonate or like materials they must be molded to the planform and cross-sectional shape of the racquet frame, as seen in FIG. 17. The planform radii may be somewhat less than that of the frame to insure a tight "clamping" fit when installed. This is contrasted to conventional nylon bumpers (one shown in FIG. 18) which are molded "flat", and are bent around the frame during installation.

Figure 19:
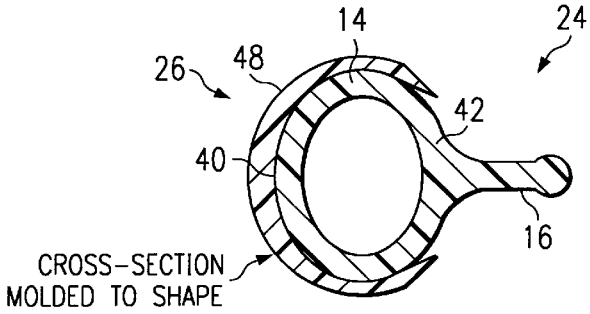
FIG. 19 is a schematic cross-section of a head frame taken near the top thereof, showing the use of the polycarbonate bumper of FIG. 17.

The embodiment shown in FIG. 17 shows string grooves 50, as opposed to string holes conventionally seen. The grooves 50 allow string protection on the outside frame surface, while guiding the string around the frame toward the positioning hole 46 in the fin 16. FIG. 19 is a cross-sectional view of a preferably polycarbonate bumper 48 as installed at the top 26 of the head frame 24. The thickness of the back wall 40 can be made to be less than that of the front wall 42 because of the structural component which is added by the polycarbonate bumper 48.

Figure 20:
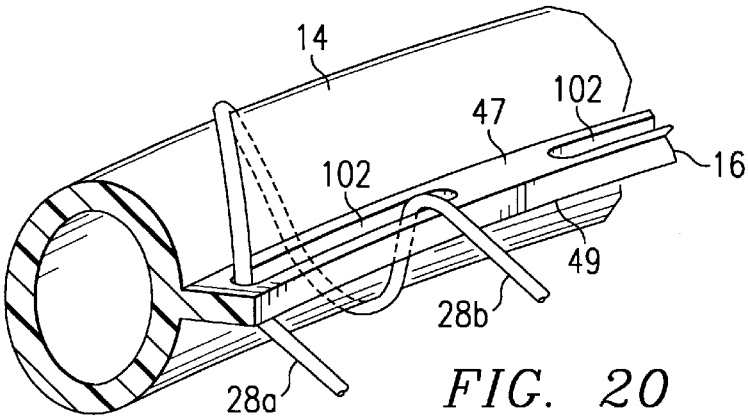
FIG. 20 is a cross-sectional detail of a further embodiment of the invention, illustrating the use of an extended slot instead of individual string holes.

FIG. 20 shows an alternative embodiment in which the string holes 46 have been replaced with elongated slots 102 that are positioned in spaced relation along the fin 16. The slots 102 each direct and align two or more of the string segments 28. In the embodiment illustrated in FIG. 20, a pair of contiguous (with each other) string segments 28*a* and 28*b* are aligned by the slot 102. A string segment 28*a* is threaded from a bottom surface 49 of the fin 16 through an elongated slot 102 to the top surface 47 of the fin 16, and thereafter around the support member 14 (preferably also being directed around a bumper which is not shown in this figure for clarity). The string, which then becomes string segment 28*b*, is threaded from bottom surface 49 through to the top surface 47 through the same slot 102 but at a different angular location from the string segment 28*a*. This embodiment permits multiple string segments to be guided using the same slot.

Figure 21:
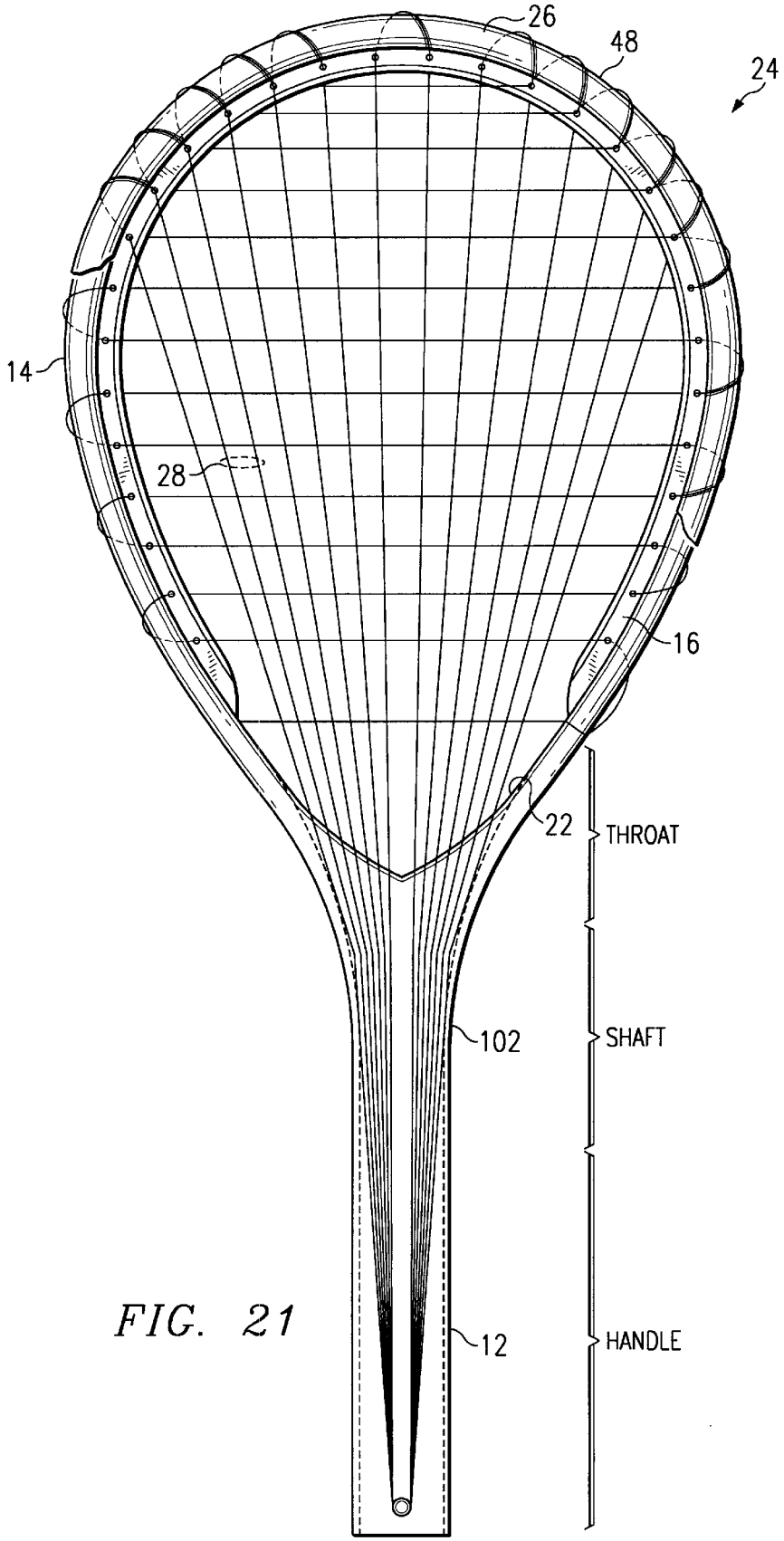
FIG. 21 is a plan view of a shafted racquet employing the invention.

FIG. 21 is a plan view of a shafted racquet for use according to the invention, such as a tennis racket. In these embodiments, the head frame 24 is connected to the handle 12 by an intervening shaft region 102. A polycarbonate bumper 48 is shown with parts broken away as installed on the tennis racket.

Figure 22:
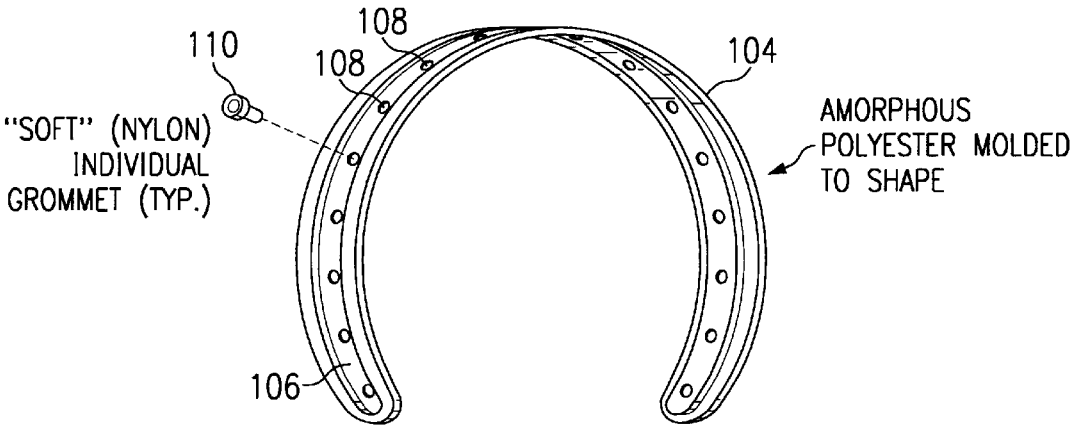
FIG. 22 is a perspective view of a polycarbonate bumper for use with other racquet designs.

Amorphous polyester bumpers according to invention may also be employed with more conventional racquet designs. FIG. 22 shows a bumper 104 made of amorphous polyester and molded to shape around a conventional head frame (not shown). The bumper 104 defines a circumferential channel 106 which includes a plurality of grommet holes 108. Each of the grommet holes in turn receives a respective grommet 110 through which the string is passed. The string is strung stitch-fashion from one of the grommet holes 108 to an adjacent grommet hole 108, where it once again passes throughout the head frame and enters the string bed.

In summary, a finned racquet has been disclosed and described which discloses a stronger support member for the support of string segments in that no or fewer holes are formed in it, but rather are formed in an associated fin. In a preferred embodiment, the fin realigns the string segments to be substantially planar up to the inner margin of the fin itself, thereby producing a racquet in which an impinging game-piece can be returned with greater angular accuracy. While the present invention has been described in conjunction with several illustrated embodiments, the invention is not limited thereto but only by the scope and spirit of the appended claims.

We claim:

1. A sports racquet, comprising:

a handle;

a frame operatively connected to the handle and defining a strung area, the frame having a string support member having two side portions on opposed sides of the strung area;

a plurality of string segments strung across the strung area;

at least one fin disposed adjacent the support member and having therein a plurality of string holes, first ones of the string segments strung to the string holes;

each of the first ones of the string segments routed so as to enter a first one of the string holes adjacent a first surface of the fin, exit the first one of the string holes adjacent a second surface of the fin, pass around the support member, enter a second one of the string holes adjacent the first surface of the fin, and exit the second one of the string holes adjacent the second surface of the fin to return to the string bed.

2. The sports racquet of claim 1, wherein the frame is directly connected to the handle.

3. The sports racquet of claim 1, wherein a shaft operatively connects the handle to the frame.

4. The sports racquet of claim 1, wherein the fin is formed integrally with and is disposed interiorly of the frame to project towards the strung area.

5. The sports racquet of claim 1, wherein the first one of the string holes is slanted away from the support member from the second surface of the fin to the first surface of the fin.

6. The sports racquet of claim 1, wherein the fin is disposed interiorly of the support member in spaced relation thereto.

7. The sports racquet of claim 1, wherein an elastomeric member is interposed between the fin and the support member.

8. The sports racquet of claim 1, wherein the first and second surfaces of the fin are substantially parallel to each other.

9. The sports racquet of claim 1, and further comprising:

at least one lug disposed on the support member and having therein at least one string hole, the lug projecting outwardly from the support member in opposition to the strung area, at least one second one of the string segments routed so as to be strung through said at least one string hole in the lug.

10. A sports racquet, comprising:

a handle;

a frame operatively connected to the handle and disposed peripherally of a strung area, the frame having two side portions on opposed sides of the strung area, the strung area substantially residing in a predetermined plane;

a plurality of string segments strung across the strung area;

at least one fin joined to the frame and having therein a plurality of string holes, the fin having at least a first surface disposed substantially in the predetermined plane, each of the string holes having an exit on the first surface;

first ones of the string segments strung to the string holes, each of a plurality of contiguous pairs of the first ones of the string segments being strung to pass around the frame, one of each pair entering a predetermined first one of the string holes and the second one of each pair entering a second predetermined one of the string holes at the first surface, the second one of each pair then being reintroduced into the strung area to reside substantially in the predetermined plane without any significant departure therefrom.

11. The sports racquet of claim 10, wherein the frame is connected directly to the handle.

12. The sports racquet of claim 10, wherein a shaft operatively connects the frame to the handle.

13. A sports racquet, comprising:

a handle;

a head frame, an elongated structural support member of the head frame having a first portion operatively connected to the handle and extending to a top opposite the handle, a second portion of the head frame joined to the first portion at the top and operatively connected to the handle such that the structural support member defines a strung area between the first and second portions;

an alignment member disposed interiorly of the structural support member and aligned with a strung area plane, a plurality of string segments strung to pass around the structural support member and to extend across the strung area, at least some of the string segments redirected by the alignment member, and further comprising a third elongated member disposed between the support member and the alignment member.

14. A sports racquet, comprising:

a handle;

a head frame, an elongated structural support member of the head frame having a first portion operatively connected to the handle and extending to a top opposite the handle, a second portion of the head frame joined to the first portion at the top and operatively connected to the handle such that the structural support member defines a strung area between the first and second portions;

an alignment member disposed interiorly of the structural support member and aligned with a strung area plane, a plurality of string segments strung to pass around the structural support member and to extend across the strung area, at least some of the string segments redirected by the alignment member, wherein the alignment member is spaced from the support member.

15. A sports racquet, comprising:

a handle;

a head frame, an elongated structural support member of the head frame having a first portion operatively connected to the handle and extending to a top opposite the handle, a second portion of the head frame joined to the first portion at the top and operatively connected to the handle such that the structural support member defines a strung area between the first and second portions;

an alignment member disposed interiorly of the structural support member and aligned with a strung area plane, a plurality of string segments strung to pass around the structural support member and to extend across the strung area, at least some of the string segments redirected by the alignment member, wherein a plurality of alignment members are each formed interiorly of the support member, each of the alignment members redirecting at least one string segment to be disposed substantially within the strung area plane.

16. A sports racquet, comprising:

a handle;

a head frame, an elongated structural support member of the head frame having a first portion operatively connected to the handle and extending to a top opposite the handle, a second portion of the head frame joined to the first portion at the top and operatively connected to the handle such that the structural support member defines a strung area between the first and second portions;

an alignment member disposed interiorly of the structural support member and aligned with a strung area plane, a plurality of string segments strung to pass around the structural support member and to extend across the strung area, at least some of the string segments redirected by the alignment member, wherein the alignment member has formed therein at least one hole for the passage of a string segment therethrough.

17. The sports racquet of claim 16, wherein the alignment member has at least first and second string holes formed to be adjacent to each other, each of the string holes receiving a string segment, the alignment member having a first surface and an opposed second surface, the first string hole being formed from the first surface to the second surface in a direction away from the strung area, the second string hole being formed from the first surface to the second surface in a direction towards the strung area.

18. The sports racquet of claim 16, wherein the hole is formed to be substantially normal to the strung area plane.

19. The sports racquet of claim 16, wherein the hole is formed to be substantially at a non-normal angle to the strung area plane.

20. A sports racquet, comprising:

a handle;

a head frame, an elongated structural support member of the head frame having a first portion operatively connected to the handle and extending to a top opposite the handle a second portion of the head frame joined to the first portion at the top and operatively connected to the handle such that the structural support member defines a strung area between the first and second portions;

an alignment member disposed interiorly of the structural support member and aligned with a strung area plane, a plurality of string segments strung to pass around the structural support member and to extend across the strung area, at least some of the string segments redirected by the alignment member, wherein different portions of the alignment member project outwardly from the structural support member at different angles to the strung area plane.

21. A sports racquet, comprising:

a handle;

a head frame, an elongated structural support member of the head frame having a first portion operatively connected to the handle and extending to a top opposite the handle, a second portion of the head frame joined to the first portion at the top and operatively connected to the handle such that the structural support member defines a strung area between the first and second portions;

an alignment member disposed interiorly of the structural support member and aligned with a strung area plane, a plurality of string segments strung to pass around the structural support member and to extend across the strung area, at least some of the string segments redirected by the alignment member, wherein the alignment member has first and second opposed surfaces which are substantially parallel to each other.

22. A sports racquet, comprising:

a handle;

an elongated head frame having two opposed ends operatively connected to the handle and disposed to laterally surround a strung area, the head frame including a support member and at least one fin projecting inwardly from the support member, said at least one fin having a surface and at least one string hole formed from the surface through said at least one fin at an angle to the plane;

a plurality of string segments extending across the strung area and having opposed ends, first ones of the string segments being passed around the support member, at least one of the ends of the first ones of the string segments strung through said at least one string hole; and an elongate bead formed on said at least one fin laterally inwardly from said at least one string hole, a thickness of the bead at the bead being greater than the thickness of the fin immediately adjacent to the bead, such that a string segment strung to said at least one string hole rides on the bead.

23. The sports racquet of claim 22, wherein the sports racquet is a racquetball racquet.

24. The sports racquet of claim 22, wherein said support member has a back surface opposed to said at least one fin, said at least one fin having at least first and second adjacent string holes and opposed first and second surfaces between which the first and second string holes are disposed, a first string segment adjacent the first surface being strung into a first one of the string holes to the second surface and passed around the back surface of the support member, a second string segment continuous with the first string segment routed back from said back surface to be inserted through the second string hole from the first surface to be adjacent the second surface and thence inwardly into the strung area; and the bead providing an eminence on both the first surface and the second surface, so that the first and second string segments only touch said at least one fin at the string holes and the bead.

25. The sports racquet of claim 22, wherein the opposed ends of the head frame are connected directly to the handle.

26. The sports racquet of claim 22, wherein a shaft operatively connects the opposed ends of the head frame to the handle.

27. A sports racquet, comprising:

a handle;

an elongated head frame having two opposed ends operatively connected to the handle and disposed to laterally surround a strung area across which a plurality of string segments are strung, the head frame including a support member and at least one fin projecting inwardly from the support member, said support member having a back surface opposed to said at least one fin, said at least one fin having at least first and second adjacent string holes and opposed first and second surfaces between which the first and second string holes are disposed, a first string segment adjacent the first surface being strung into a first one of the string holes to the second surface and passed around the back surface of the support member, a second string segment continuous with the first string segment routed back from said back surface to be inserted through the second string hole from the first surface to be adjacent the second surface and thence inwardly into the strung area; and a bead formed on the fin, the bead providing an eminence on both the first surface and the second surface, so that the first and second string segments only touch said at least one fin at the string holes and the bead.

28. A sports racquet, comprising:

a handle;

a head frame, an elongated structural support member of the head frame having a first portion operatively connected to the handle and extending to a top opposite the handle, a second portion of the head frame joined to the first portion at the top and operatively connected to the handle such that the structural support member defines a strung area between the first and second portions;

a first alignment member disposed interiorly of the structural support member and substantially disposed above a strung area plane, a second alignment member disposed interiorly of the structural support member and substantially disposed below the strung area plane; and a plurality of string segments strung to pass around the structural support member and to extend across the strung area, at least some of the string segments redirected by the first alignment member, at least others of the string segments redirected by the second alignment member.

* * * * *